US006840822B1

(12) United States Patent
Hall et al.

(10) Patent No.: US 6,840,822 B1
(45) Date of Patent: Jan. 11, 2005

(54) CABLE CONNECTOR

(75) Inventors: John Wesley Hall, Harrisburg, PA (US); Hurley Chester Moll, Harrisburg, PA (US); Michael Fredrick Laub, Harrisburg, PA (US); Charles Randall Malstrom, Lebanon, PA (US); Dmitry Vladimirovich Zhmurkin, Harrisburg, PA (US); John Mark Myer, Millersville, PA (US); John Phillup Huss, Jr., Harrisburg, PA (US); Nathan Lincoln Tracy, Harrisburg, PA (US); Sean Patrick McCarthy, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/647,552

(22) Filed: Aug. 25, 2003

(51) Int. Cl.[7] ..... H01R 13/40
(52) U.S. Cl. ..... 439/752.5; 439/595
(58) Field of Search ..... 439/740, 752.5, 439/595, 733.1, 744, 746

(56) References Cited

U.S. PATENT DOCUMENTS 3,944,312 A * 3/1976 Koenig ..... 439/357
5,017,162 A * 5/1991 Krehbiel et al. ..... 439/752
5,910,031 A * 6/1999 Goto ..... 439/752.5
5,993,268 A * 11/1999 Yamaguchi ..... 439/752.5

FOREIGN PATENT DOCUMENTS

GB 2036465 A * 6/1980 ..... 439/744

* cited by examiner

*Primary Examiner*—Tho D. Ta

(57) ABSTRACT

A cable connector is provided. The cable connector includes a connector housing having a cavity for receiving a contact along an axis, and the cavity has a protrusion therein. The protrusion extends through the axis so that as the contact is inserted into the cavity along the axis, the contact is deflected by the protrusion until the contact moves past the protrusion into a locked position. The contact has a body section with at least one wing extending therefrom. The wing contacts the protrusion as the contact is inserted into the cavity along the axis causing the contact to rotate about the axis.

9 Claims, 11 Drawing Sheets

CABLE CONNECTOR

CROSS REFERENCE TO RELATED APPLICATIONS

U.S. patent application Ser. No. 10/005,625, filed Dec. 5, 2001, U.S. patent application Ser. No. 10/004,979, filed Dec. 5, 2001, and U.S. patent application Ser. No. 10/037,185, filed Jan. 4, 2002 describe subject matter related to the present application and are hereby expressly incorporated by reference in their entirety.

BACKGROUND OF THE INVENTION

Certain embodiments of the present invention generally relate to a connector for interconnecting coaxial cables and more particularly to a connector having contacts arranged in a strip line geometry. Certain embodiments of the present invention generally relate to a ground shield and center contact arrangement for a connector.

In the past, connectors have been proposed for interconnecting coaxial cables. Generally, coaxial cables have a circular geometry formed with a central conductor (of one or more conductive wires) surrounded by a cable dielectric material. The dielectric material is surrounded by a cable braid (of one or more conductive wires), and the cable braid is surrounded by a cable jacket. In most coaxial cable applications, it is preferable to match the impedance between source and destination electrical components located at opposite ends of the coaxial cable. Consequently, when sections of coaxial cable are interconnected, it is preferable that the impedance remain matched through the interconnection.

Today, coaxial cables are becoming more widely used. The wider applicability of coaxial cables demands a high-volume, low-cost manufacturing process for coaxial cable connectors. Recently, demand has arisen for radio frequency (RF) coaxial cables in applications such as the automotive industry. The demand for RF coaxial cables in the automotive industry is due in part to the increased electrical content within automobiles, such as AM/FM radios, cellular phones, GPS, satellite radios, Blue Tooth™ compatibility systems and the like. Also, conventional techniques for assembling coaxial cables and connectors are not suitable for automation, and thus are time consuming and expensive. The conventional procedure for assembling a connector and coaxial cable is not easily automated and requires several manual steps that render the procedure time consuming and expensive.

Today's increased demand for coaxial cables has caused a need to improve the design for coaxial connectors and the methods of manufacture and assembly thereof.

BRIEF SUMMARY OF THE INVENTION

In accordance with an embodiment of the present invention, a cable connector is provided. The cable connector includes a connector housing having a cavity for receiving a contact along an axis, and the cavity has a protrusion therein. The protrusion extends through the axis so that as the contact is received by the cavity along the axis, the contact is deflected by the protrusion until the contact moves past the protrusion into a locked position.

In accordance with another embodiment of the present invention, the contact has a body section with at least one wing extending therefrom. The wing contacts the protrusion as the contact is received by the cavity along the axis causing the contact to twist about the axis.

Optionally, the cavity of the cable connector has a top wall and a bottom wall defining a channel for receiving the contact along the axis. The protrusion extends from the top wall so as to bend the contact until the contact moves past the protrusion.

In accordance with another embodiment of the present invention, a connector housing is provided with a latch extending therefrom. The connector housing is receivable within an outer housing. The outer housing has a cantilever section formed into the housing. The cantilever section has a slot therethrough. The cantilever section is deflected by the latch as the connector housing is inserted into the outer housing until the latch extends through the slot.

In accordance with another embodiment of the present invention, a contact shell is provided. The contact shell includes a pair of side walls and a connecting wall extending therebetween. At least one side wall has at least one tab extending therefrom, with the tab having an arcuate tip. The contact shell is coupled to a strain relief by a separation plate.

In accordance with another embodiment of the present invention, a contact shell further includes a displacement section extending between a pair of side walls of the contact shell. The displacement section includes a displacement beam and a contact wall separated by a slot. The contact wall slopes upward to form a point for piercing a coaxial cable.

Figure 1:
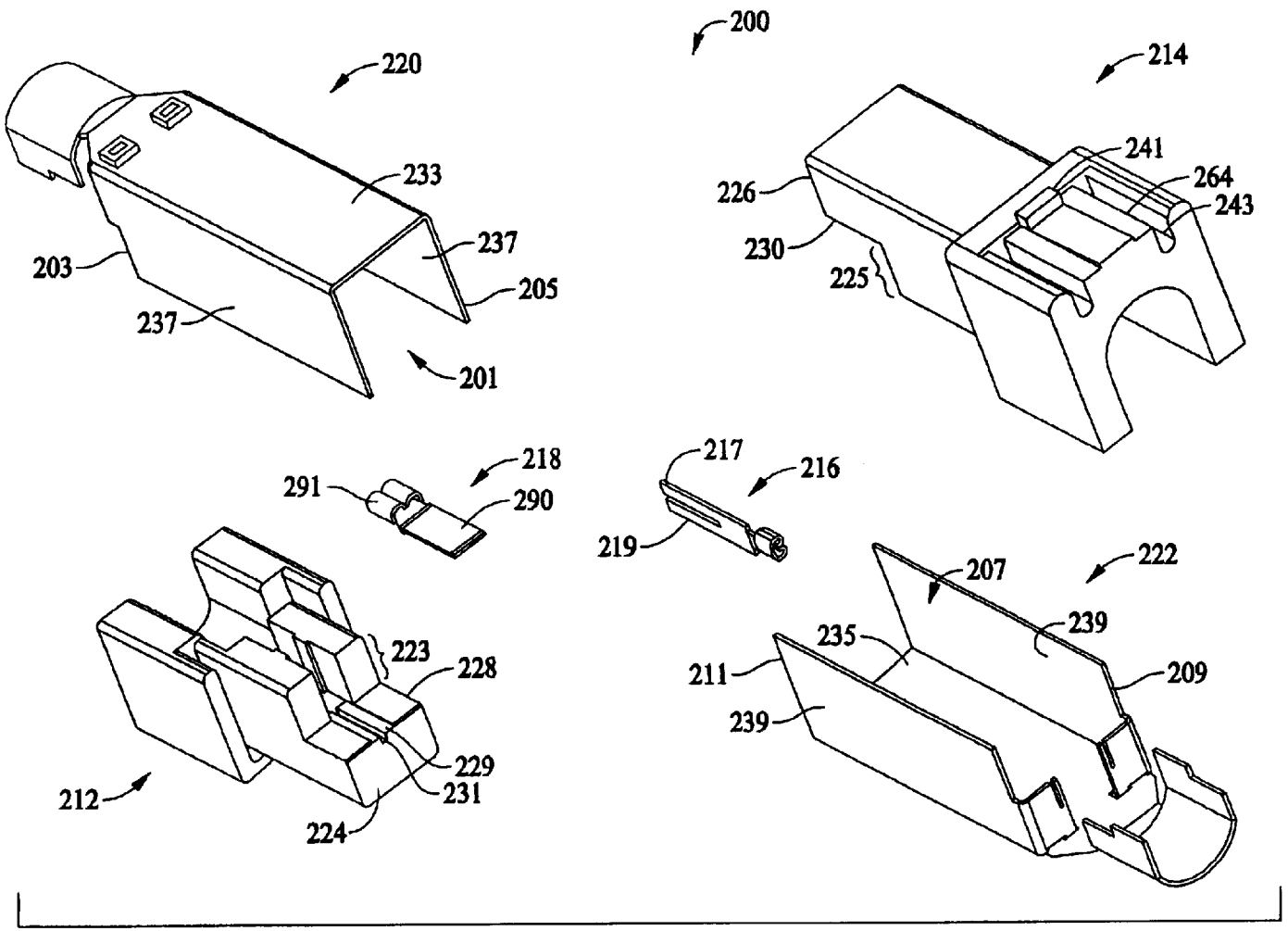
FIG. 1 illustrates an exploded isometric view of a connector.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

FIG. 1 illustrates a coaxial cable connector 200 that has been more fully described in U.S. application Ser. Nos. 10/005,625 and 10/004,979, all assigned to the assignee of the present application. The coaxial cable connector 200 is shown to better understand the subject of the present application which is described in connection with FIGS. 2–16. The coaxial cable connector 200 includes insulated housings or dielectrics 212 and 214, a receptacle contact 216, a blade (plug) contact 218, and shield contacts 220 and 222. The shield contacts 220 and 222 include side walls 237 and 239, respectively, and connecting walls 233 and 235, respectively. The first and second insulated housings 212 and 214 include mating faces 224 and 226, respectively, that have notched portions 223 and 225 and shelves 228 and 230, respectively. The shelf 228 includes a notch 229 that accepts a body section 290 of the plug contact 218. The shelf 228 also includes a slot 231 that accepts a finger 219 of the receptable contact 216.

The side walls 237 and 239, and corresponding connecting walls 233 and 235, are formed in U-shapes and have open faces 201 and 207, respectively. The side walls 237 and 239 include contact retention ends 203 and 209, and open ends 205 and 211, respectively, opposite one another. The open faces 201 and 207 extend from the contact retention ends 203 and 209 to the open ends 205 and 211, respectively.

Figure 2:
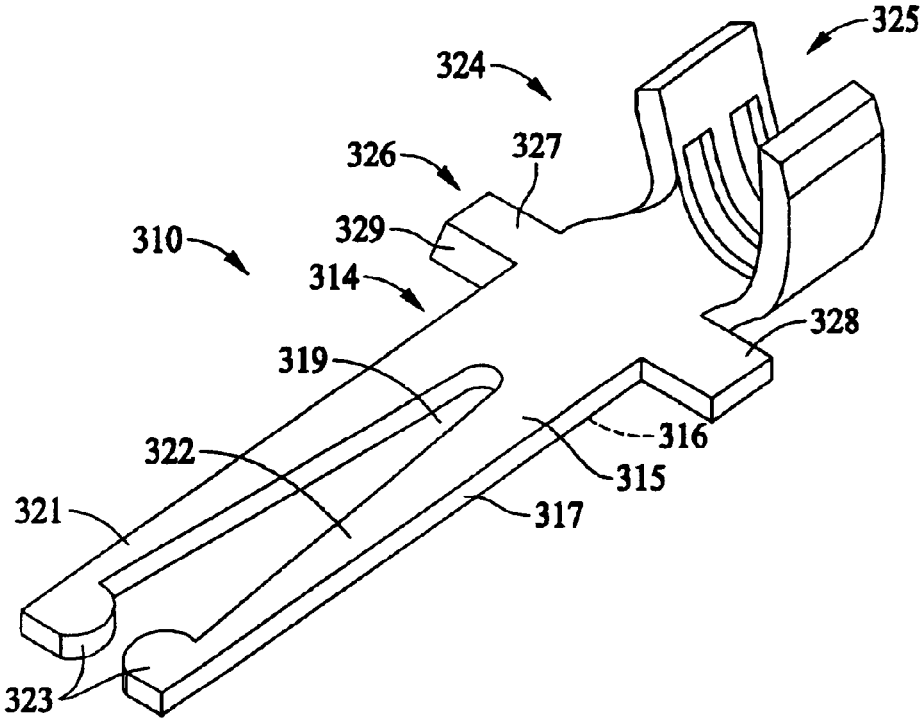
FIG. 2 illustrates a center contact formed in accordance with at least one embodiment of the present invention.
Figure 3:
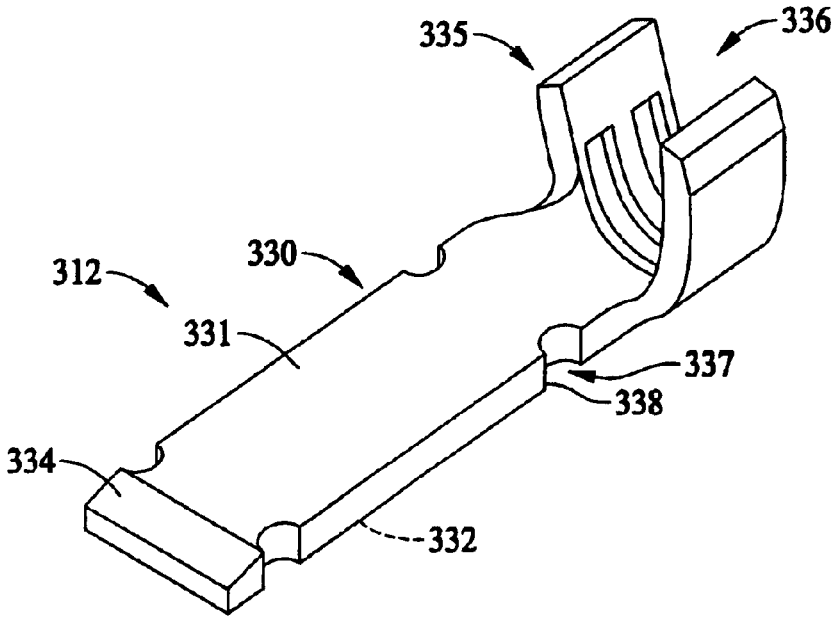
FIG. 3 illustrates at least one center contact formed in accordance with an embodiment of the present invention.

FIGS. 2 and 3 illustrate alternative receptacle and plug contacts 310 and 312, respectively. In FIG. 2, the receptacle contact 310 is illustrated having a planar body section 314 with a top surface 315, a bottom surface 316, and side edges 317. Body section 314 has a slot 319 cut in an outer end thereof to form a fork having fingers 321 and 322. At the outer ends of the fingers 321 and 322, rounded projections 323 are provided in the opening to the slot 319 and are oriented to face one another. The projections 323 ensure a repeatable interconnection point between the receptacle contact 310 and a joining plug contact 312 when the plug contact 312 is inserted into the slot 319. An opposite end of the body section 314 includes a wire barrel 324 having an opening 325 that receives a center conductor of a coaxial cable. The wire barrel 324 is securely crimped to the center conductor of the coaxial cable using an "F" crimp or other style.

At least one wing 326 extends laterally from the side edges 317 of body section 314 and is located along the body section 314 between the fingers 321 and 322 and the wire barrel 324. As shown in FIG. 2, the receptacle contact 310 has a first wing 327 and a second wing 328. First wing 327 has a chamfer 329 on the top surface 315. The chamfer 329 slopes from the top surface 315 to the bottom surface 316. The chamfer 329 extends substantially along the span of the first wing 327. Second wing 328 also has a chamfer (not shown) on the bottom surface 316. The chamfer of the second wing slopes from the bottom surface 316 to the top surface 315.

FIG. 3 illustrates a plug contact 312 having a planar body section 330 with a top surface 331 and a bottom surface 332. The planar body section 330 has a beveled outer end 334 for insertion between the projections 323 on the receptacle contact 310. An opposite end of the body section 330 includes a wire barrel 335 having an opening 336 that receives a center conductor of the corresponding coaxial cable. The wire barrel 335 is formed to securely attach to the center conductor of the coaxial cable. At least one shoulder 337 is formed into the body section 330 providing a retention surface 338.

Figure 5:
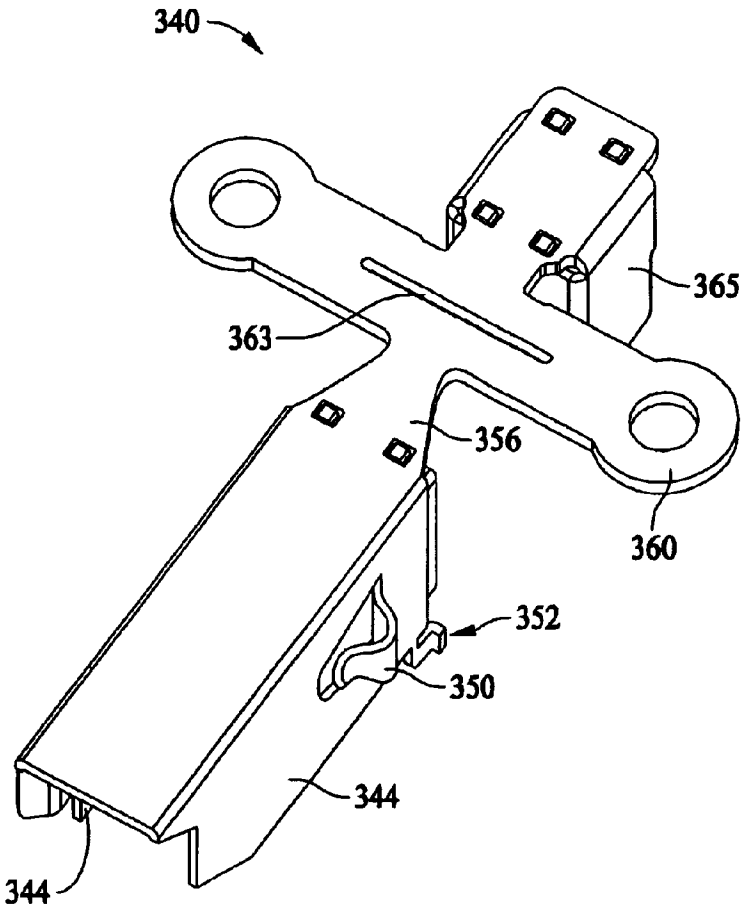
FIG. 5 illustrates an isometric view of a shell formed in accordance with at least one embodiment of the present invention.
Figure 4:
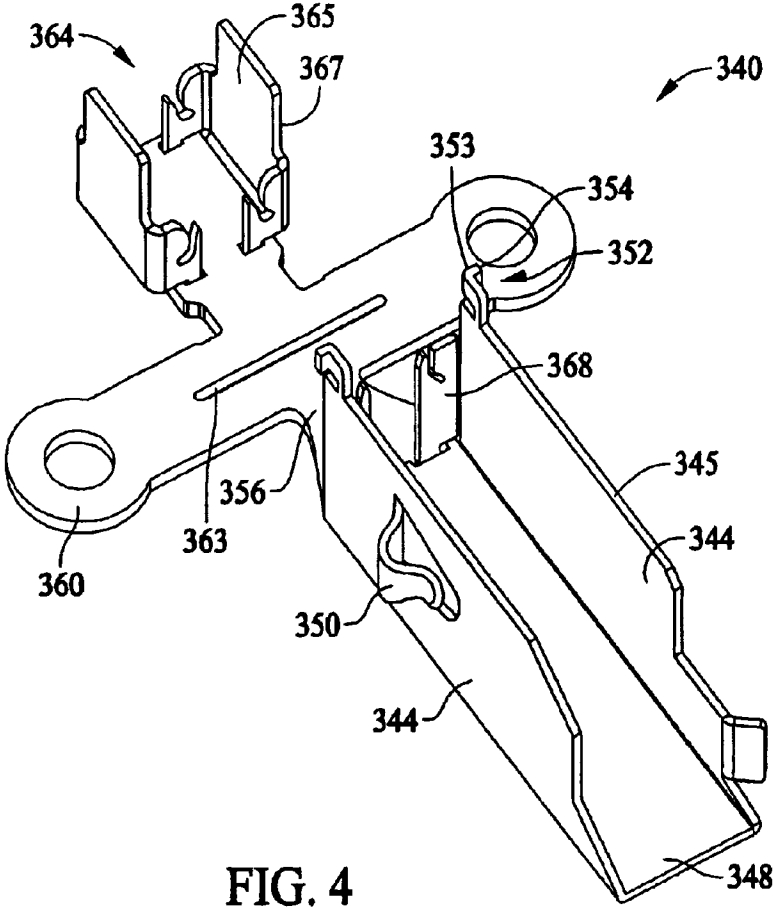
FIG. 4 illustrates an isometric view of a shell formed in accordance with at least one embodiment of the present invention.

FIGS. 4 and 5 illustrate opposite views of an alternative configuration for a contact shell or outer contact. Each contact shell 340 includes side walls 344 with a top surface 345 and a connecting wall 348. A projection 350 is provided on at least one side wall 344 to ensure a proper electrical connection between mating outer contacts 340.

At least one tab 352 extends from the top surface 345 of one of the side walls 344. As shown in FIG. 4, a pair of tabs 352 extend from the top surfaces 345 of the side walls 344. Each tab 352 has an arcuate tip 353 with a tip end surface 354. The tip end surfaces 354 of each respective tab 352 face outward opposite each other. Tabs 352 also form a positive alignment with a window in the dielectric assuring proper contact location. Optionally, each tip end surface 354 may be facing any direction independently of one another. Optionally, both tip end surfaces 354 may be substantially parallel to each other. Since the tabs 352 extend higher than the side walls 344, the tabs 352 extend beyond the center line of a cable when the cable is received within the contact shell 340. Thus, the tabs 352 prevent pinching of the cable in the event a portion of the cable spills out over the top surface 345 of the side walls 344.

The connecting walls 348 includes a transition region 356 at a rear end thereof that is formed integrally with a laterally extending carrier strip or separation plate 360. The separation plate 360 includes a slot 363 to facilitate cutting of the separation plate 360 during assembly. The separation plate 360 is in turn formed integrally with a strain relief crimp 364. During assembly, the strain relief crimp 364 is physically separated from the transition region 356, such as through a stamping operation, and then secured to the coaxial cable.

Figure 6:
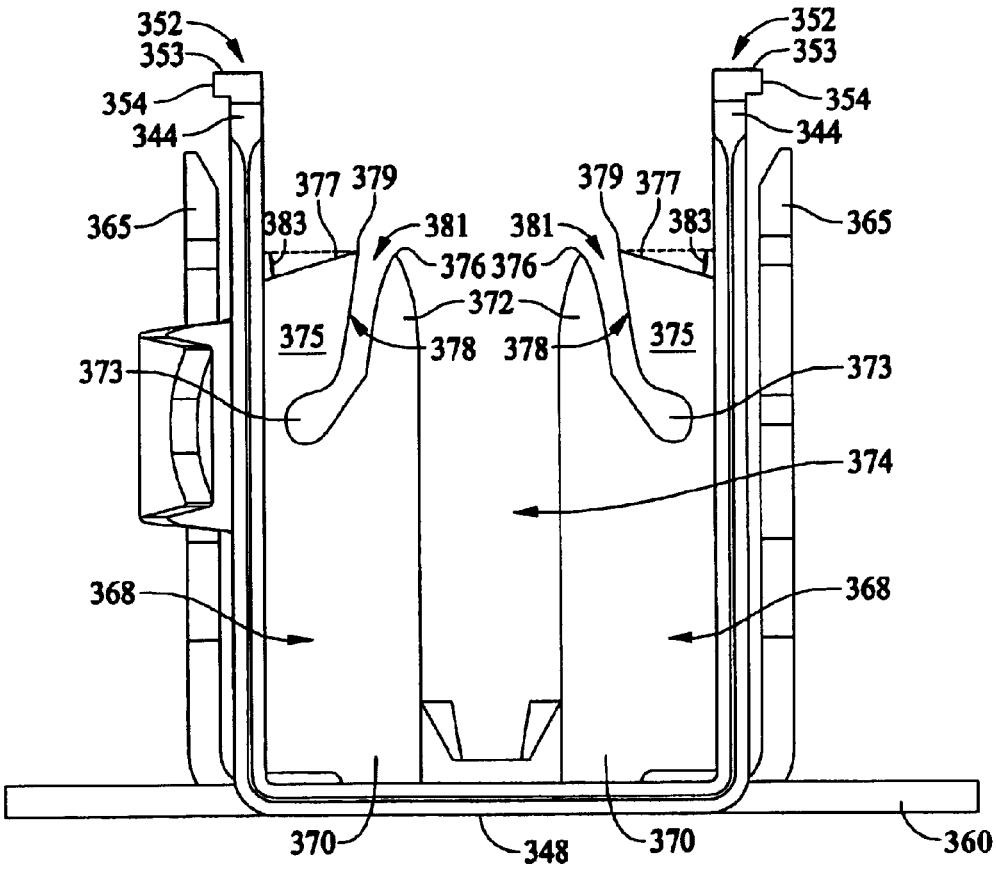
FIG. 6 illustrates an end view of a shell formed in accordance with at least one embodiment of the present invention.

FIG. 6 illustrates an end view of contact shell 340. The coaxial cable displacement contacts 368 include support projections 370 formed on lower ends thereof to be loosely received in openings in the connecting wall 348. The displacement beams 372 extend upward and are separated from one another by a gap 374. The displacement beams 372 include pointed tips 376 that facilitate penetration of the jacket and outer conductor of the corresponding coaxial cable. Braid receiving slots 378 extend downward and are flared outward away from the gap 374 at base wells 373 to form a hooked shape. Tabs 352 extend upward from the sidewalls 344 and are flared outward such that the end tip surfaces 354 face opposite to each another.

The contact walls 375 include tapered undercut edges 377 extending along the top of the coaxial cable displacement contacts 368. The undercut edges 377 end at lead tips 379 which face one another and are located at mouths 381 of the braid receiving slots 378. The contact walls 375 shear the cable jacket away from the outer conductor as the coaxial cable displacement contacts 368 engage and pierce the coaxial cable.

Figure 7:
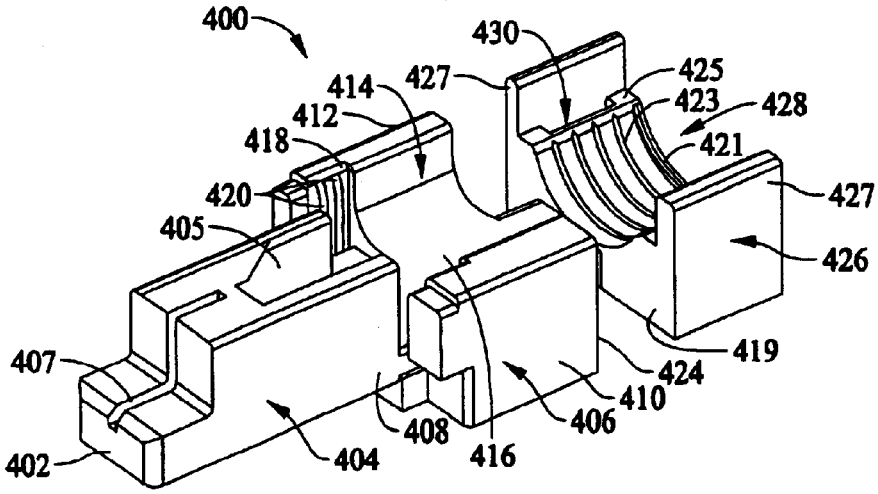
FIG. 7 illustrates an isometric view of an insulated housing formed in accordance with at least one embodiment of the present invention.
Figure 8:
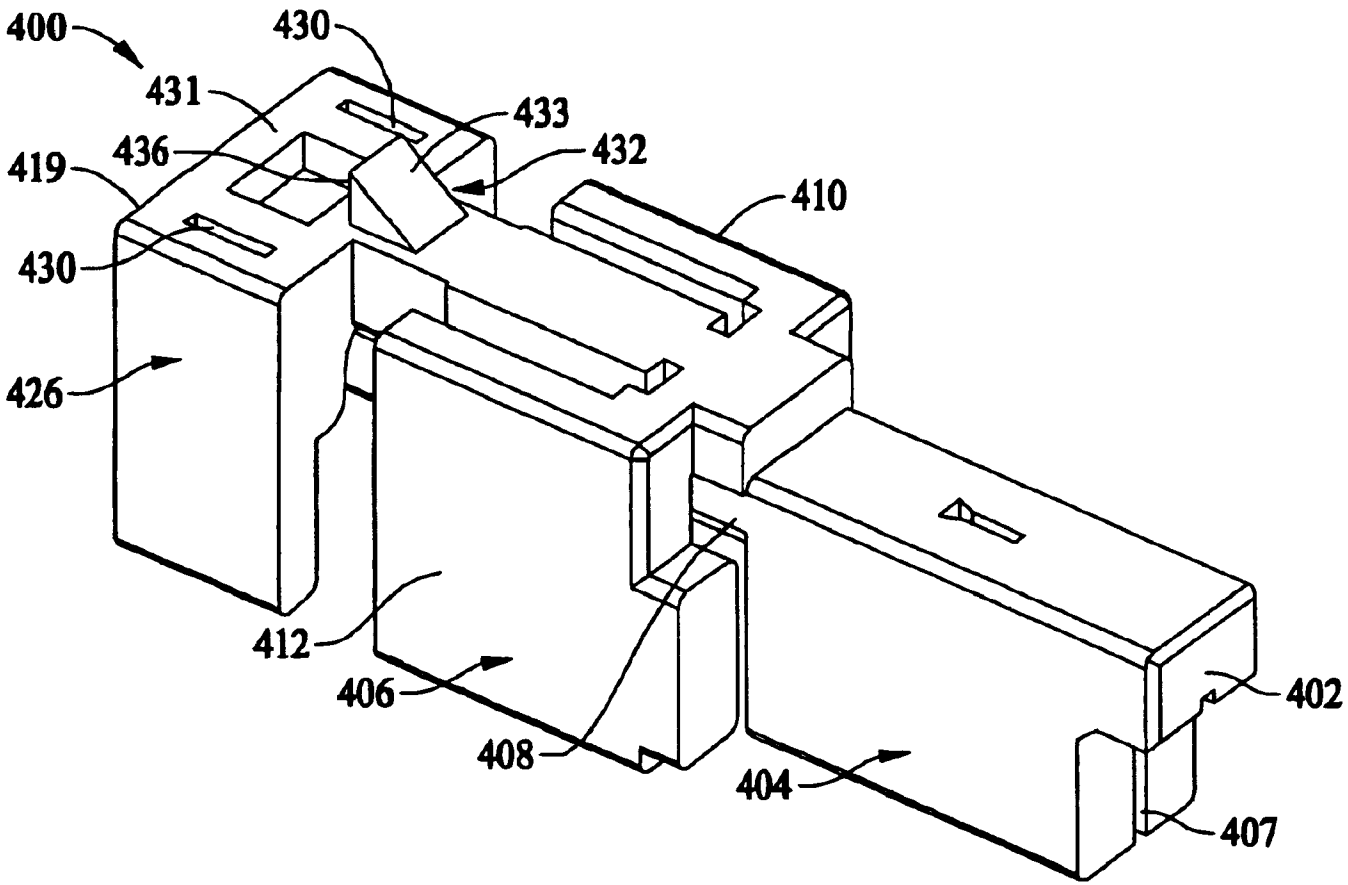
FIG. 8 illustrates an isometric view of an insulated housing formed in accordance with at least one embodiment of the present invention.

FIGS. 7 and 8 illustrate opposite views of an alternative embodiment for a dielectric housing 400 that may be used in one or both halves of a connector. The insulated housing 400 includes a mating face 402 on a front end of a rectangular body section 404. The body section 404 includes a cavity 405 adapted to receive a leading end of the coaxial cable and a crimp on a plug or receptacle contact 312 or 310 attached thereto. A front end of the body section 404 includes a slot 407 that accepts an associated one of the plug and receptacle contacts 312 and 310. A rear end of the body section 404 is formed with a shroud 406 through a joining section 408. The shroud 406 includes opposed side walls 410 and 412 cooperating to define a U-shaped chamber 414 therebetween that receives the coaxial cable. Interior surfaces of the side walls 410 and 412 include notches 416 and 418 facing one another and extending vertically in a direction transverse to a length of the insulated housing 400. At least one of the notches 416 and 418 define a contact shell receiving slot 420.

A rear end 424 of the shroud 406 is joined with a strain relief member 426 having a base 419 with a U-shaped notch 428 therein. The notch 428 in the strain relief member 426 includes an inner surface 421 having transverse arcuate grooves 423. Opposite ends of the notch 428 form ledges 425. FIG. 8 is a perspective view of the rear side 431 of the insulated housing 400. A latch 432 extends from the rear side 431 and is generally disposed between the strain relief member 426 and the body section 404. The latch 432 has a sliding surface 433 and a retention surface 436. The latch 432 is formed integrally to the housing 400 and is substantially triangular in shape.

Figure 9:
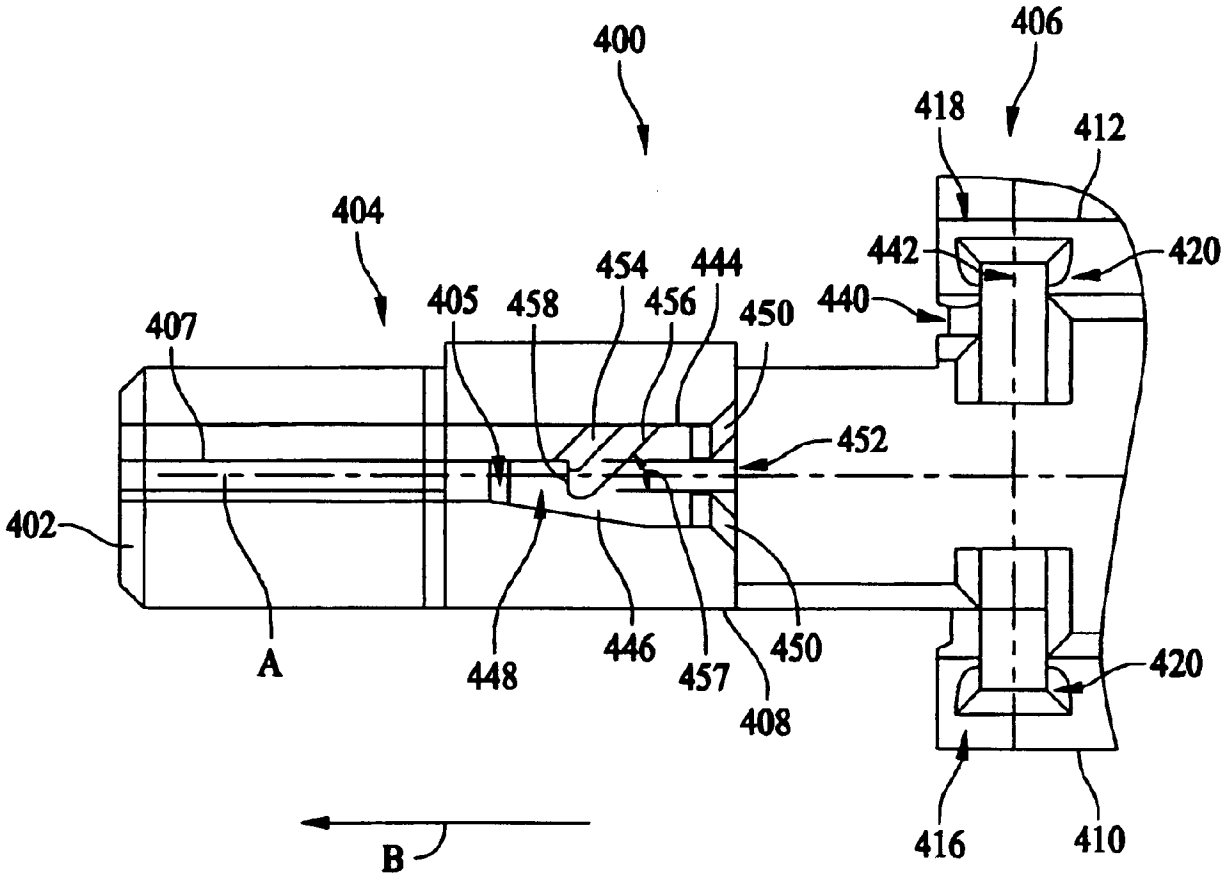
FIG. 9 illustrates a partial top view of the insulated housing shown in FIG. 7.

FIG. 9 is a partial top view of the insulated housing 400 shown in FIGS. 7 and 8. The contact shell receiving slot 420 includes an arcuate tip slot 440 and a side wall slot 442 that extends along the length of the corresponding notch 416 and 418. The arcuate tip slot 440 receives the arcuate tip 353 of the tab 352 and the side wall slot 442 receives the tip end surface 354 of the contact shell 340 when the contact shell 340 is coupled to the insulated housing 400. In addition, the contact shell receiving slots 420 helps locate the placement of the side walls 344 and tabs 352 within the contact shell receiving slot 420.

The cavity 405 has a side wall 444 and a bottom surface 446 defining a channel 448 for receiving the associated contact, such as the receptacle 310, along an axis A. A pair of posts 450 extend from the bottom surface 446 at an entrance to the cavity 405 defining a central passage 452 into the channel 448. The central passage 452 is substantially aligned with axis A. At least one protrusion 454, such as a rigid finger or a bump, extends from the bottom surface 446 and along one of the side walls 444 into the channel 448. The finger 454 extends into the channel 448 enough to intercept axis A so as to be an obstruction to the receptacle 310 as the receptacle 310 is received by the cavity 405 along axis A. Optionally, the finger 454 may extend from one of the sidewalls 444.

As shown in FIG. 9, the finger 454 has a twisting surface 456 and a locking surface 458. The locking surface 458 is substantially perpendicular to axis A. The twisting surface 456 forms an acute angle 457 with respect to axis A. As the receptacle 310 is received or inserted into the cavity 405 in the direction of arrow B, the body section 314 of the receptacle 310 is directed through the central passage 452 along axis A. Depending on how the receptacle 310 was inserted into the cavity 405, either the first wing 327 or the second wing 328 contacts the finger 454. If the first wing 327 contacts the finger 454, the chamfer 329 of the first wing 327 contacts the finger 454 to help the first wing 327 slide past the finger 454. If the second wing 328 contacts the finger 454, the chamfer of the second wing 328 contacts the finger 454 to help the second wing slide past the finger 454.

As the receptacle 310 continues to move in the direction of arrow B, the respective wing travels along the twisting surface 456 of the finger 454. As the wing moves along the twisting surface 456, the wing twists or rotates the receptacle 310 about axis A. The receptacle 310 twists until the wing is past the finger 454 at which time the receptacle 310 springs back to its normal undeflected shape. Once the receptacle 310 is past the finger 454 and has returned to its normal shape, the receptacle 310 is locked into position by the first and second wings 327 and 328 contacting the locking surface 458 of the finger 454.

Figure 10:
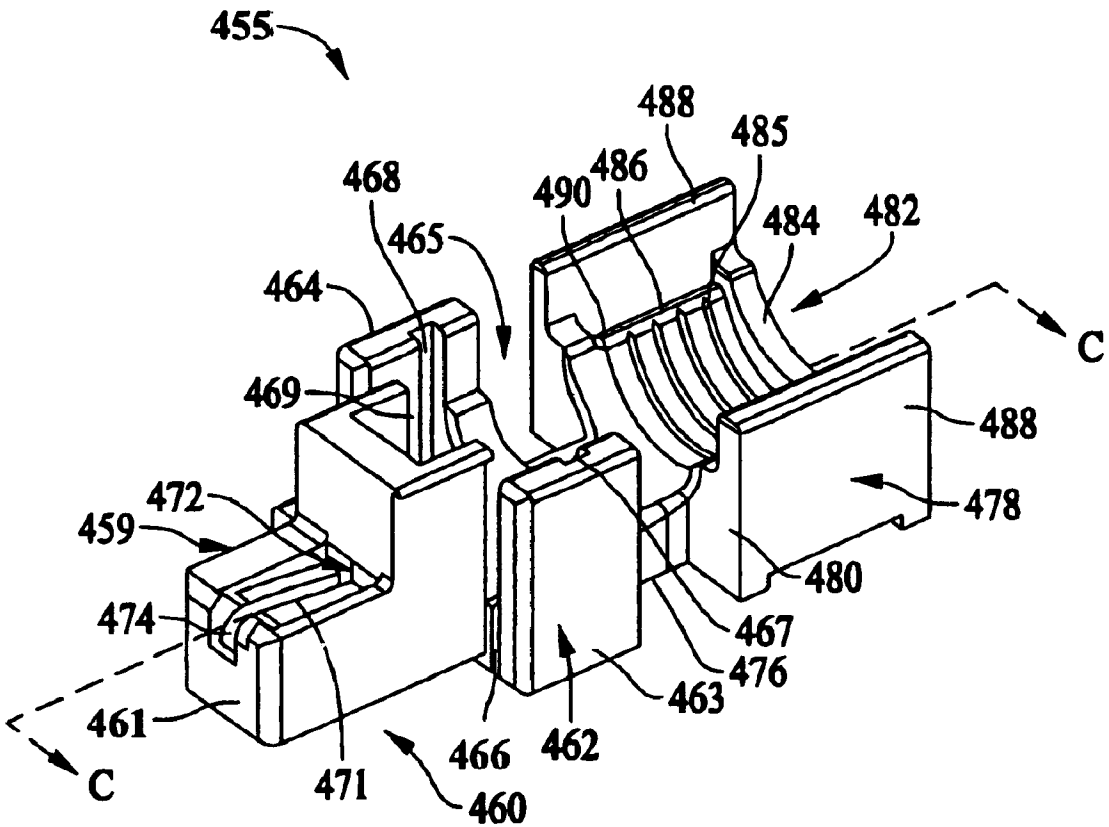
FIG. 10 is a perspective view of an insulated housing formed in accordance with an alternative embodiment of the present invention.

FIG. 10 is a perspective view of an alternative embodiment for a dielectric 455 that may be used in both halves of a connector. The dielectric 455 includes a mating face 461 on a front end 459 of a rectangular body section 460. A rear end of the body section 460 is formed with a shroud 462 through a joining section 466. The shroud 462 includes opposed side walls 463 and 464 cooperating to define a U-shaped chamber 465 therebetween that receives the coaxial cable. Interior surfaces of the side walls 463 and 464 include notches 467 and 468 facing one another and extending vertically in a direction transverse to a length of the insulated housing 455.

The body section 460 includes a chamber 469 adapted to receive a leading end of the coaxial cable and a crimp on a plug or receptacle contact 312 or 310 attached thereto. The front end 459 of the body section 460 also includes a ramp 471 angled downward to a ramp opening 472 into the chamber 469. The ramp 471 includes a slot 474 that accepts an associated one of the plug and receptacle contacts.

A rear end 476 of the shroud 462 is joined with a strain relief member 478 having a base 480 with a U-shaped notch 482 therein. The notch 482 in the strain relief member 478 includes an inner surface 484 having transverse arcuate grooves 485. Opposite ends of the notch 482 form ledges 486. Side walls 488 extend upward from the ledges 486 along opposite sides of the notch 482. Channels 490 are formed in each ledge 486 and extend through the strain relief member 478 to a rear side. The channels 490 are spaced apart to align with and receive the arms 365 when the contact shell 340 is laterally joined with insulated housing 455. The length of each channel 490 is slightly less than an outer dimension of the ribs 367 such that, as the arms 365 are pressed into channels 490, the ribs 367 engage ledge 486 to hold the strain relief crimp 364 and strain relief member 478.

Figure 11:
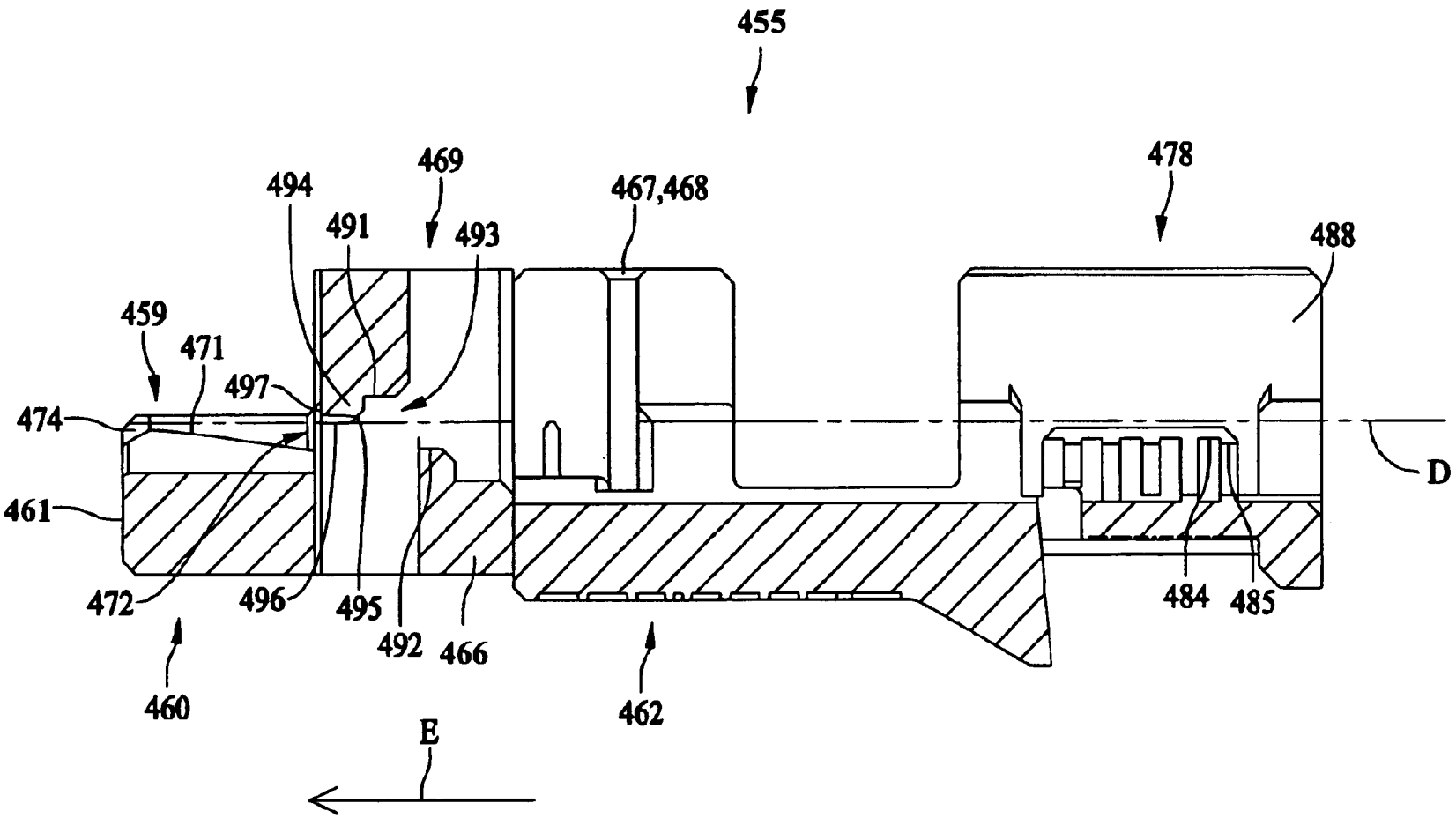
FIG. 11 is a cutaway side view taken along arrow C of FIG. 12.

FIG. 11 is a cutaway side view taken along arrow C of FIG. 10 of the alternative embodiment of the insulated housing 455 configured to receive the receptacle contact 310. The chamber 469 has a top wall 491 and a bottom wall 492, defining a channel 493 for receiving the plug contact 312 along an axis D.

At least one protrusion or ledge 494 extends from the top wall 491. The protrusion 494 or ledge extends into the channel 493 enough to intercept axis D so as to be an obstruction to the plug contact 312 as the plug contact 312 is received by the chamber 469 along axis D. As shown in FIG. 11, the ledge 494 has a sliding surface 495, a planar surface 496 substantially parallel to axis D, and a locking surface 497.

The plug contact 312 is received through channel 493 along axis D in the direction of arrow E, such that top and bottom surfaces 331 and 332 of the plug contact 312 are substantially parallel to the bottom wall 492. Once the outer end 334 of the plug contact 312 contacts the ledge 494, the plug contact 312 travels along the sliding surface 495 and is directed to the ramp 471. Initially, the outer end 334 or the plug contact 312 helps the plug contact 312 slide along sliding surface 495. As the plug contact 312 continues to travel along axis D, the ledge 494 deflects or bends the plug contact 312 while the plug contact 312 travels through the ramp opening 472 and upward along the ramp 471. The plug contact 312 continues to bend until the body section 330 moves past the ledge 494, resulting in the plug contact 312 to spring back to its normal or undeflected shape. Once the plug contact 312 is past the ledge 494 and returns to its normal shape, the plug contact 312 is locked into position by the retention surface 338 of the plug contact 312 contacting the locking surface 497 of the ledge 494.

Figure 12:
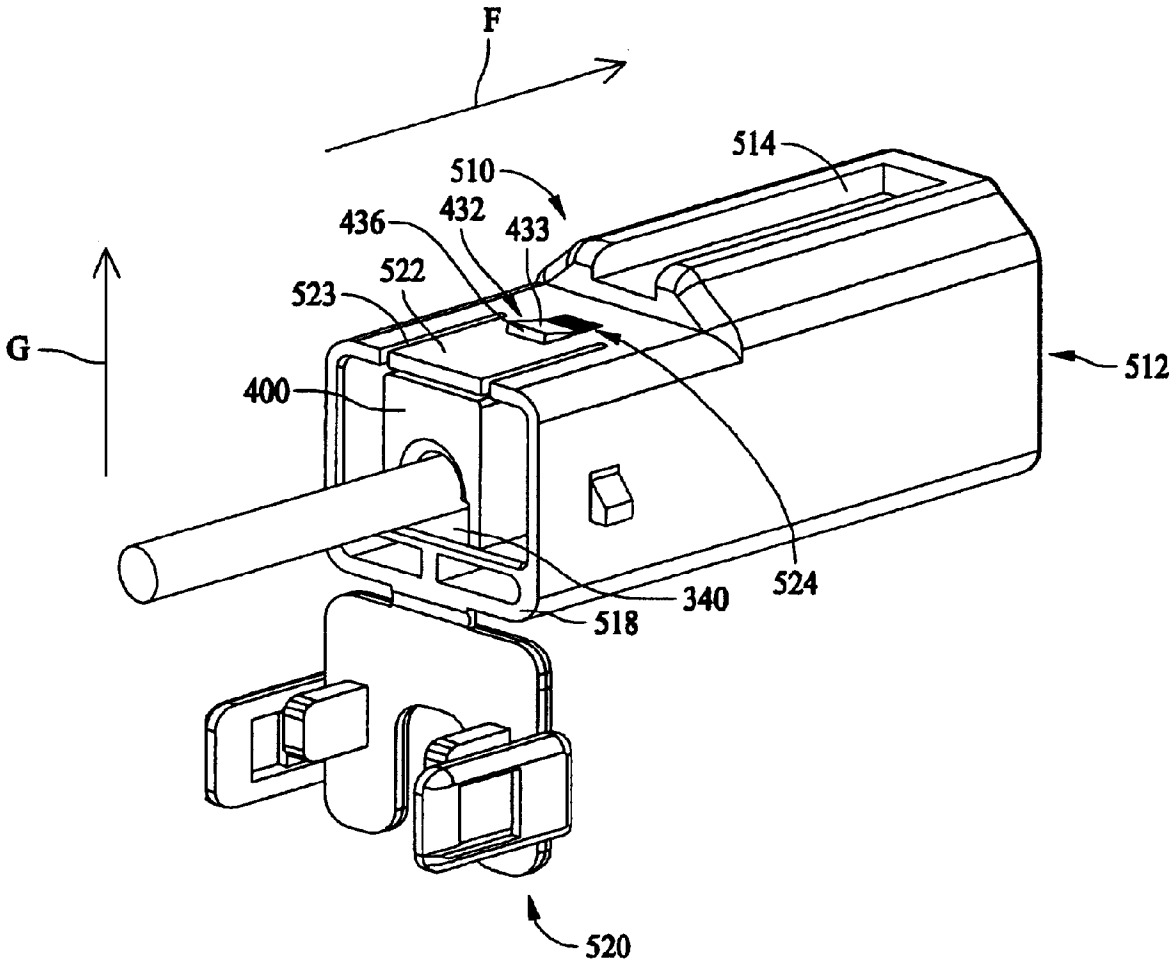
FIG. 12 illustrates an outer housing and coaxial with at least one embodiment of the present invention.

FIG. 12 illustrates an outer housing 510 provided over another of the shells 340 once mounted to an insulated housing 400. The outer housing 510 is configured to mate with another outer housing (not shown). The outer housing 510 includes a mating end 512 adapted to receive an end of the other outer housing. A slot 514 is provided in one side of the outer housing 510 to accept the latch projection on the latch beam of the other outer housing. An opposite end 518 of the outer housing 510 is formed with a secondary lock member 520.

The end 518 has a cantilever member 522 formed into the outer housing 510 by substantially parallel housing slots 523. The cantilever member 522 has a slot 524 provided therethrough. As the housing 400 is loaded into the outer housing 510 in the direction of arrow F, the latch 432 of the housing 400 deflects the cantilever member 522 generally in the direction of arrow G. The sliding surface 433 of the latch 432 continues to slide under the cantilever member 522 until the latch 432 reaches the slot 524 of the cantilever member 522. Once the latch 432 is disposed within the slot 524, the cantilever section 522 returns to its normal and undeflected shape thereby locking the housing 400 within the outer housing 510. The housing 400 is retained within the outer housing 510 by the retaining surface 436 of the latch 432 extending outward through the slot 524.

Figure 13:
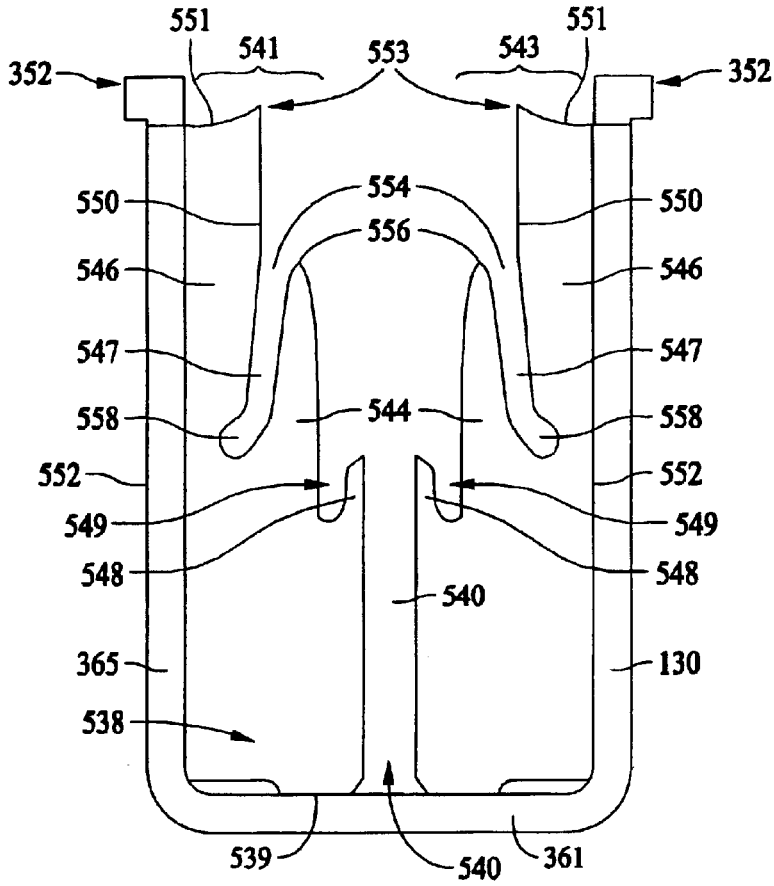
FIG. 13 illustrates a coaxial cable displacement contact formed in accordance with an alternative embodiment of the present invention.

FIG. 13 illustrates an end view of an alternative embodiment of the coaxial cable displacement contacts of the contact shell 340. The coaxial cable displacement contact 538 may be formed on either one of the side walls or a connecting wall, such as one of the arms 365 or connecting body portion 361. Optionally, the displacement contact 538 can be formed on either one of the side walls or a connecting wall at both ends of the coaxial cable displacement contacts. The coaxial cable displacement contact 538 is aligned in a plane perpendicular to the longitudinal axis of a corresponding contact shell, such as contact shell 340. In the example of FIG. 13, the coaxial cable displacement contact 538 is joined with the connecting wall, such as the body portion 361, along edge 539.

The coaxial cable displacement contact 538 includes a gap 540 defining a channel between forked displacement sections 541 and 543. Each displacement section 541 and 543 includes a first displacement beam 544 and a contact wall 546 separated by a first slot 547 and a second displacement beam 548 separated by a second slot 549. Upper ends of the contact walls 546 include lead-in edges 550 and piercing edges 551. The piercing edges 551 slope upwards from outer edges 552 of the coaxial cable displacement contact 538 to meet the lead-in edges 550 at a point 553. The lead-in edges 550 slope inward and downward to join mouths 554 of the slots 547 proximate tips 556 on upper ends of the displacement beams 544. The lead-in edges 550 direct the cable jacket onto the displacement beams 544. Lower ends of the slots 547 include wells 558 configured to receive the outer jacket of the coaxial cable when the first and second displacement beams 544 and 548 pierce the outer jacket of the cable, thereby mechanically stabilizing the cable to the coaxial cable displacement contact 538. The spacing between the displacement beams 544, 548 and the slots 547, 549 is determined based upon the dimensions of a coaxial cable to be secured therein.

Figure 14:
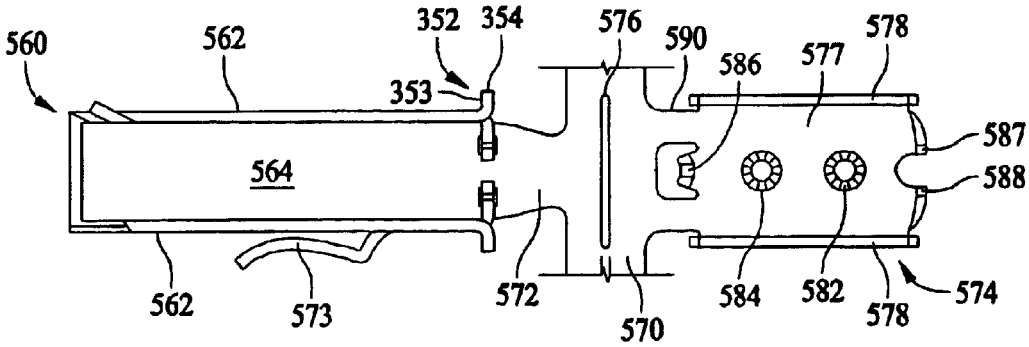
FIG. 14 illustrates a top plan view of a contact shell formed in accordance with an alternative embodiment of the present invention.
Figure 15:
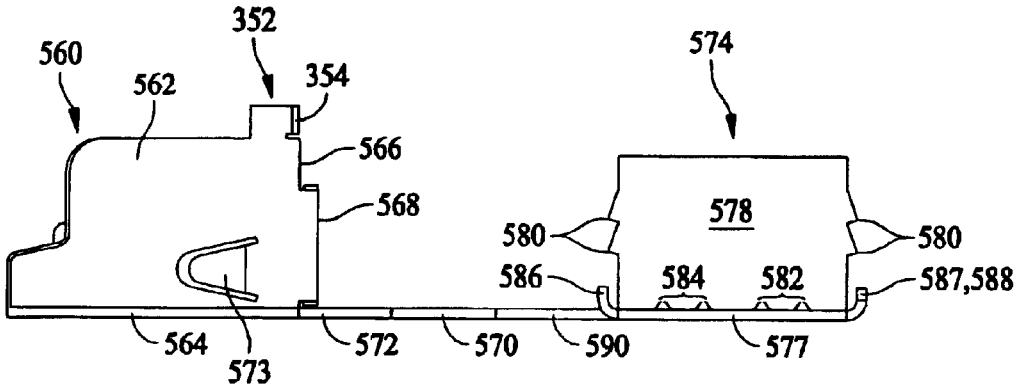
FIG. 15 illustrates a side view of a contact shell formed in accordance with an alternative embodiment of the present invention.

FIGS. 14 and 15 illustrate an alternative embodiment for a contact shell 560. The contact shell 560 includes side walls 562 and a connecting wall 564. A contact retention end 566 of the side walls 562 includes coaxial cable displacement contacts 568. The connecting wall 564 is joined with a separation plate 570 through a transition region 572. At least one spring finger 573 extends from one of the side walls 562. The spring finger 573 helps capture the mating contact shell and draws the two contact shells together assuring a good connection.

The separation plate 570 is in turn connected to a strain relief crimp 574 through a transition region 590. The separation plate 570 includes a slot 576 to facilitate cutting of the separation plate 570. Optionally, the strain relief crimp 574 is separated from the contact shell 560 at the separation plate 570, such as by cutting through the slot 576. Once the strain relief crimp 574 is separated from the contact shell 560, the mechanical function of the strain relief crimp 574 is separated from the electrical function of the contact shell 560. By separating the mechanical function to from the electrical function, the strain relief crimp 574 is prevented from acting like an antennae.

The strain relief crimp 574 is U-shaped and includes a body portion 577 having arms 578 on opposite sides thereof and extending upward therefrom. The arms 578 include ribs 580 on opposite sides thereof. The strain relief crimp 574 operates in the same manner as the strain relief crimps 364 (discussed above in connection with FIGS. 4 and 5) to frictionally engage channels in a mating strain relief member (such as channels 430 in strain relief member 426 in FIGS. 7 and 8).

Figure 16:
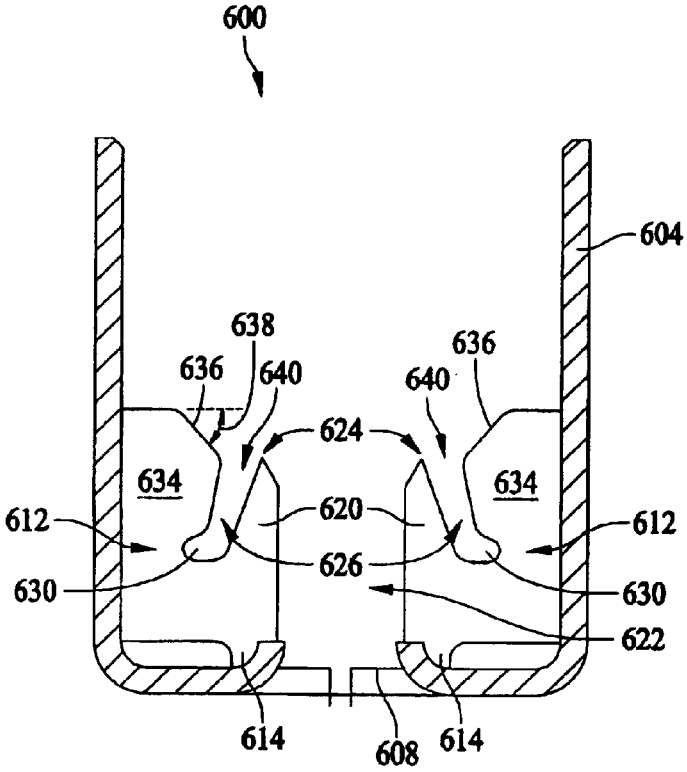
FIG. 16 illustrates an end view of a strain relief in accordance with an alternative embodiment of the present invention.

FIG. 16 is an end view of a preferred embodiment of a strain relief crimp 600. The strain relief crimp 600 includes sidewalls 604 and a connecting wall 608. Strain relief crimp 600 includes at least one coaxial cable displacement contacts 612 to pierce a dielectric, a braid and a jacket. The coaxial cable displacement contacts 612 include support projections 614 formed on lower ends thereof to be loosely received in openings in the connecting wall 608. Displacement beams or fangs 620 extend upward and are separated from one another by a gap 622. The fangs 620 include pointed tips 624 that facilitate penetration of the jacket and outer conductor of the corresponding coaxial cable. Receiving slots 626 extend downward and are flared outward away from the gap 622 at base wells 630 to form a hooked shaped.

Contact walls 634 include tapered edges 636 extending downward toward mouths 640 of the receiving slots 626. The contact walls 634 penetrate the cable jacket away from the outer conductor as the coaxial cable displacement contacts 612 engages and pierces the coaxial cable. The tapered edges 636 form an acute angle 638 with the horizontal (denoted by a dashed line) to facilitate shearing. By shearing the cable jacket away from the outer conductor before entering the mouth 640, the coaxial cable displacement contacts 612 prevent the cable jacket from becoming wedged in the braid receiving slots 626.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications that incorporate those features which come within the spirit and scope of the invention

What is claimed is:

1. A cable connector comprising a connector housing having a cavity for receiving a contact along an axis, said cavity having a protrusion therein, said protrusion including a twisting surface, and said protrusion extending through the axis so that, as said contact is inserted into said cavity along said axis, said contact is deflected by said protrusion until said contact moves past said protrusion into a locked position.

2. The cable connector according to claim 1 wherein said contact has a body section with at least one wing extending therefrom, said wing contacting said protrusion as said contact is inserted into said cavity along said axis causing said contact to rotate about said axis.

3. The cable connector according to claim 1 wherein said contact has a chamfer for contacting said protrusion to help said contact move past said protrusion.

4. The cable connector according to claim 1 wherein said protrusion has a chamfer for contacting said contact to help said contact move past said protrusion.

5. The cable connector according to claim 1 wherein said connector housing has at least one post at an entrance to said cavity to guide said contact along said axis before said contact is inserted into said cavity.

6. The cable connector according to claim 1 wherein said cavity has a top wall and a bottom wall defining a channel for receiving said contact along said axis, said protrusion extends from said top wall so as to bend said contact until said contact moves past said protrusion.

7. The cable connector according to claim 1 wherein said protrusion is a finger having a locking surface.

8. The cable connector according to claim 1 wherein said connector housing has a latch extending therefrom, said connector housing receivable within an outer housing, said outer housing having a cantilever section formed into said housing, said cantilever section having a slot therethrough, said cantilever section deflected by said latch as said connector housing is inserted into said outer housing until said latch extends through said slot.

9. A cable connector comprising a connector housing having a body section formed with a shroud at an end thereof, said shroud coupled to said body section through a joining section, said body section defining a cavity for receiving a contact along an axis, said cavity having a protrusion therein, said protrusion extending through the axis so that, as said contact is inserted into said cavity along said axis, said contact is deflected by said protrusion until said contact moves past said protrusion into a locked position.

* * * * *